US007420333B1

(12) United States Patent
Hamdad et al.

(10) Patent No.: US 7,420,333 B1
(45) Date of Patent: Sep. 2, 2008

(54) MIXED MODE CONTROL FOR DIMMABLE FLUORESCENT LAMP

(75) Inventors: Fatemeh Hamdad, Sunnyvale, CA (US); Hubertus Notohamiprodjo, Union City, CA (US)

(73) Assignee: Marvell International Ltd., Hamilton (BM)

( * ) Notice: Subject to any disclaimer, the term of this patent is extended or adjusted under 35 U.S.C. 154(b) by 429 days.

(21) Appl. No.: 10/883,342

(22) Filed: Jul. 1, 2004

Related U.S. Application Data

(60) Provisional application No. 60/540,222, filed on Jan. 29, 2004.

(51) Int. Cl.
*H05B 37/02* (2006.01)

(52) U.S. Cl. ..... 315/224; 315/225; 315/209 R; 315/307; 315/294

(58) Field of Classification Search ..... 315/224, 315/225, 209 R, 291, 307, 294, 247, 246
See application file for complete search history.

(56) References Cited

U.S. PATENT DOCUMENTS 3,836,797 A * 9/1974 Steen ..... 327/172
5,434,479 A * 7/1995 Ohnishi et al. ..... 315/209 R
7,061,189 B2 * 6/2006 Newman et al. ..... 315/291
2002/0017897 A1 * 2/2002 Wilcox et al. ..... 323/282
2002/0158613 A1 * 10/2002 Muratov et al. ..... 323/284
2003/0122605 A1 * 7/2003 Ulrick et al. ..... 327/309
2004/0085031 A1 * 5/2004 Hsieh ..... 315/291
2004/0174122 A1 * 9/2004 Ribarich ..... 315/307

OTHER PUBLICATIONS

Johnson, Steven D. amd Erickson, Robert W., *Steady-State Analysis and Design of the Parallel Resonant Converter*, IEEE Transactions on Power Electronics, vol. 3, No. 1, Jan. 1988, pp. 93-104.
Cosby, Melvin C., Jr. and Nelms, R.M., *A Resonant Inverter for Electronic Ballast Applications*, IEEE Transactions on Industrial Electronics, vol. 41, No. 4, Aug. 1994, pp. 418-425.
Nelms, R.M., *Harmonic Analysis of a Parallel-Loaded Resonant Converter*, IEEE Transactions on Aerospace and Electronic Systems, vol. 27, No. 4, Jul. 1991, pp. 683-688.
Kazimierczuk, Marian K. and Szaraniec, Wojciech, *Electronic Ballast for Fluorescent Lamps*, IEEE Transactions on Power Electronics, vol. 8, No. 4, Oct. 1993, pp. 386-395.

* cited by examiner

*Primary Examiner*—Tuyet Vo

(57) ABSTRACT

A mixed mode control for dimmable fluorescent lamp provides a smooth and continuous control of output of the lamp. A load threshold, below which the output of the discharge lamp could not be effectively controlled by the conventional frequency control, is determined. During the dimming of the discharge lamp, when the load is not lower than the load threshold, the conventional frequency control is employed. However, when the load is lower than the load threshold, a complementary duty cycle control is used.

30 Claims, 19 Drawing Sheets

Freq=125kHz; $I_{lamp}$=0.3Amps; D=0.5

Freq = 167kHz (1/6us); $I_{lamp}$=0.2Amps, D=0.5

$I_{lamp}$=0.1Amps; Freq = 167kHz (1/6us); D=0.33 (2us/6us)

Freq = 167kHz (1/6us); $I_{lamp}$=0.05Amps, D=0.28

MIXED MODE CONTROL FOR DIMMABLE FLUORESCENT LAMP

CROSS-REFERENCE TO RELATED APPLICATIONS

This application claims the benefit of Provisional Application No. 60/540,222, filed Jan. 29, 2004. This application incorporates the provisional application by reference.

BACKGROUND OF THE INVENTION

1. Field of the Invention

The present invention relates to control of a dimmable discharge lamp, and more specifically to generation of a dimming current for a fluorescent lamp.

2. Description of the Related Art

The electronic ballast for fluorescent lamp dimming control could use either a series LC resonant series loaded circuit, a series resonance parallel loaded circuit, or a series parallel resonance circuit, controlled by either the frequency or the duty cycle of input voltage pulses. The existing duty cycle control employs symmetrically chopped pulses. The series LC resonant series loaded and series parallel resonance circuits are not commonly used for electronic ballast because they behave like a band-pass filter, and so cannot satisfy the high gain required at high impedance for ignition and low load dimming.

The most common type of conventional electronic ballast uses a series resonance parallel loaded circuit, the structure of which is shown in FIG. 1A. They behave like a low-pass filter and show a high gain at high impedance that is required during ignition and low dimming by the fluorescent lamp. The input of the ballast comes from a DC source that could be a pre-stage power factor correction (PFC) universal boost unit. Switching elements S1 and S2 turn on and off in response to a signal from a controller 10 to convert the DC voltage into an AC voltage. The controller 10 controls states of the switching elements S1 and S2, and thus the waveform of the AC voltage, in accordance with a desired dimming level from a dimmer 11. That is, by adjusting the dimmer 11, the current $I_{lamp}$ flowing through a fluorescent lamp 12 can be changed, and the light output of the fluorescent lamp 12 can be varied. A resonance circuit, comprising an inductor L and a capacitor C1, is formed between the switching stage, including switching elements S1 and S2, and the fluorescent lamp 12. A capacitor C2 blocks DC voltage to the fluorescent lamp 12.

The main relations among the signals in the circuit are as follows:

$$i_L = i_{lamp} + C1(dv_{C1}/dt) \tag{1}$$

$$v_{c1} = V_{in} - L(di_L/dt) = \frac{1}{C1}\int (i_L - i_{lamp})dt + V_{c1}(IC) \tag{2}$$

$$v_{c2} = V_{in} - L(di_L/dt) - R_{lamp}\cdot i_{lamp} = \frac{1}{C2}\int i_{lamp}dt + V_{c2}(IC) \tag{3}$$

wherein $V_{c1}$(IC) is the Initial Condition of voltage across C1, and $V_{c2}$(IC) is the Initial Condition of voltage across C2.

As shown in FIG. 1B, the series resonance parallel loaded circuit behaves as a low-pass filter. The fundamental frequency of the square input pulse would be in the pass band of the network and higher harmonics mainly would be attenuated. The transfer function of the series resonance parallel loaded circuit is:

$$G_p(jw) = \frac{Vo(j\omega)}{Vi(j\omega)} = \frac{1}{\sqrt{\left(1-\left(\frac{\omega}{\omega o}\right)^2\right)^2 + \left(\frac{\omega}{\omega o Qp}\right)^2}}$$

wherein, $\omega_o = 1/\sqrt{LC1}$ $Q_o = R/L\omega_o = RC\omega_o$

The series resonant parallel loaded ballast with double switch choppers at the DC output of the PFC boost is preferred over other conventional ballasts, because it is adjustable with high voltage requirement at high impedance of ignition, is short circuit proof, and its voltage increases in high impedance and low load during dimming.

According to one of the conventional approaches, the controller 10 changes the current $I_{lamp}$ by controlling the frequency $f_{sw}$ at which the switching elements S1 and S2 turn on and off. The frequency control is used with a fixed duty cycle D=50%. Square pulses of $V_{in}$ to the ballast are assumed to be DC modulated with a sine wave of switching frequency. The DC component shifts the AC voltage across C1 and is blocked by C2. The average DC voltage, $V_{av}=V_{dc}/2$, remains constant in all loads and a uniform resonance sine wave is assumed over the whole period.

As shown in FIG. 2, at higher loads the current $I_{lamp}$ increases with the decrease of the frequency $f_{sw}$. However, in some threshold of low dim range, the curve becomes flat, and the light output of the fluorescent lamp 12 cannot be effectively adjusted by changing the frequency $f_{sw}$. This threshold depends on the lamp characteristic, input/output voltage, as well as the optimized component selection of C1 and L.

Another disadvantage of conventional frequency control dimming is that in this flat area of low load control the ballast is too sensitive to the frequency changes. When the frequency $f_{sw}$ is raised quickly, the response of the circuit is so fast that the ballast becomes unstable. Thus, conventionally, only gradual dimming could be used.

According to another conventional approach, the controller 10 changes the current $I_{lamp}$ by controlling the duty cycle $D_{sw}$ of the switching elements S1 and S2. As shown in FIG. 3, dimming is achieved by reducing pulse width of both switches symmetrically, and symmetric charge/discharge time is used to avoid DC voltage drop. However, there is a gap between the turn on (or close) time of the two switching elements, which may cause a discontinuous conduction mode in a resonant tank circuit at low dimming, and high peak current that lowers the efficiency.

Therefore, it would be advantageous to provide a method and apparatus for effective and efficient control of the dimming of the fluorescent lamp.

SUMMARY OF THE INVENTION

It is an object of the present invention to provide smooth and continuous control of the output of a discharge lamp. A load threshold, below which the output of the discharge lamp could not be effectively adjusted by the conventional frequency control, is determined. During the dimming of the discharge lamp, when the load is not lower than the load threshold, a conventional frequency control is employed. However, when the load is lower than the load threshold, a complementary duty cycle control is used. The duty cycle of input pulses to a resonance circuit of a ballast is reduced to lower the output of the lamp.

The present invention uses the general structure of the conventional series resonant parallel loaded ballast with double switch choppers. In low dim light, when one of the switching elements turns off, the other one complementarily turns on. There is no gap between the turn on time of the two switching elements, except for a short delay to prevent short circuit. There is no overlap between the turn on time of the two switching elements, either.

In the conventional duty cycle control, the dimming is achieved by reducing pulse width of both switches. However, in the present invention, the turn on time of one of the switching elements is reduced, but the turn on time of the other switching element is complementarily increased.

BRIEF DESCRIPTION OF THE DRAWINGS

The present invention is described herein with reference to the accompanying drawings, similar reference numbers being used to indicate functionally similar elements.

DETAILED DESCRIPTION OF EMBODIMENTS

Objects and advantages of the present invention will become apparent from the following detailed description.

Figure 4:
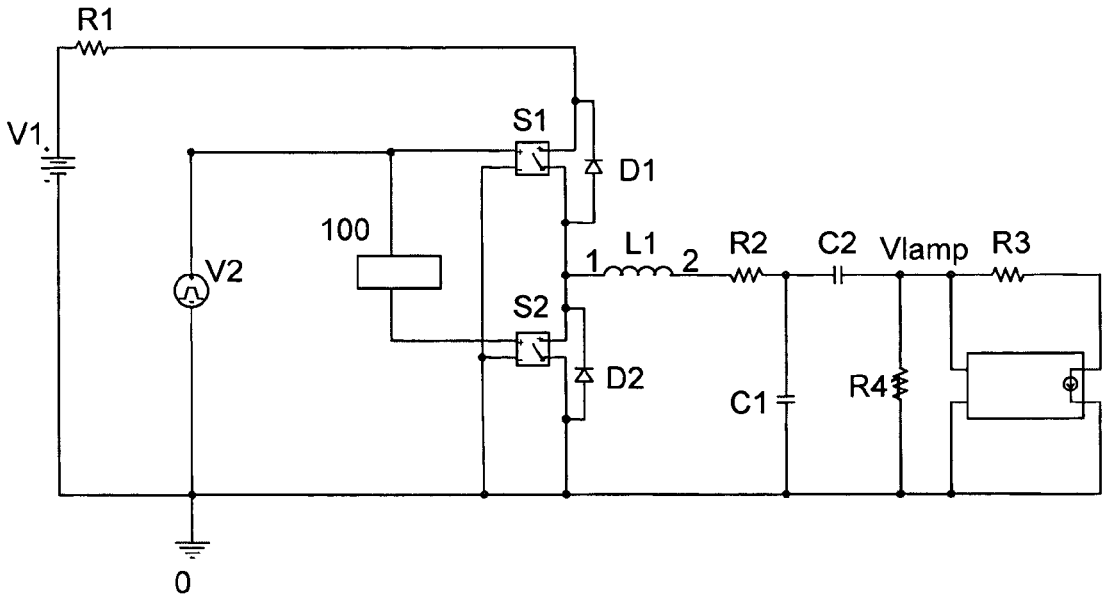
FIG. 4 shows the simulation circuit of a mixed mode ballast for controlling dimmable fluorescent lamp according to one embodiment of the present invention. The lamp is modeled by a current controlled voltage source to simulate its VI characteristics.

The present invention employs the general structure of the conventional series resonant parallel loaded ballast with double switch choppers. FIG. 4 shows a mixed mode ballast for controlling a dimmable fluorescent lamp according to one embodiment of the present invention. To provide a smooth and continuous control range of 100% to 10% or lower light control, the present invention provides a mixed mode controller 100 to control the switching elements S1 and S2. The present invention also optimizes the values of L, C1 and C2 of the ballast. The switching elements could be transistors, specifically, FETs.

Figure 1A:
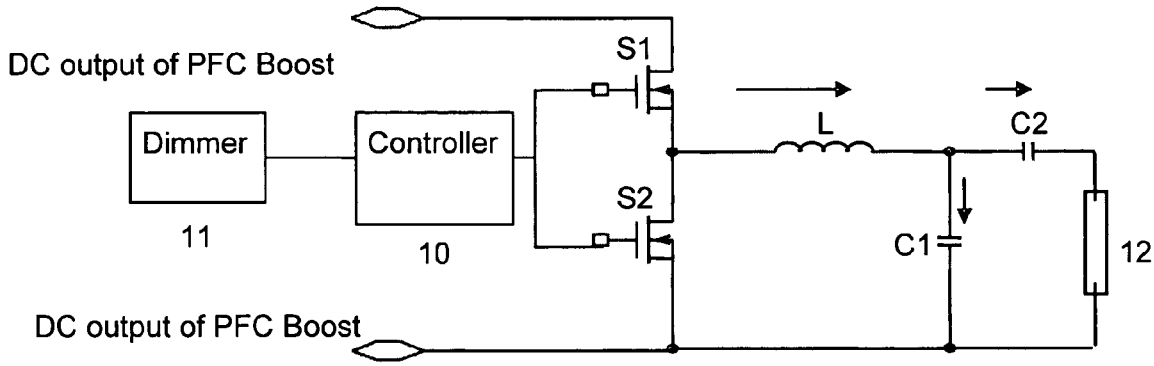
FIG. 1A shows the structure of an electronic ballast using a series resonance parallel loaded circuit.
Figure 1B:
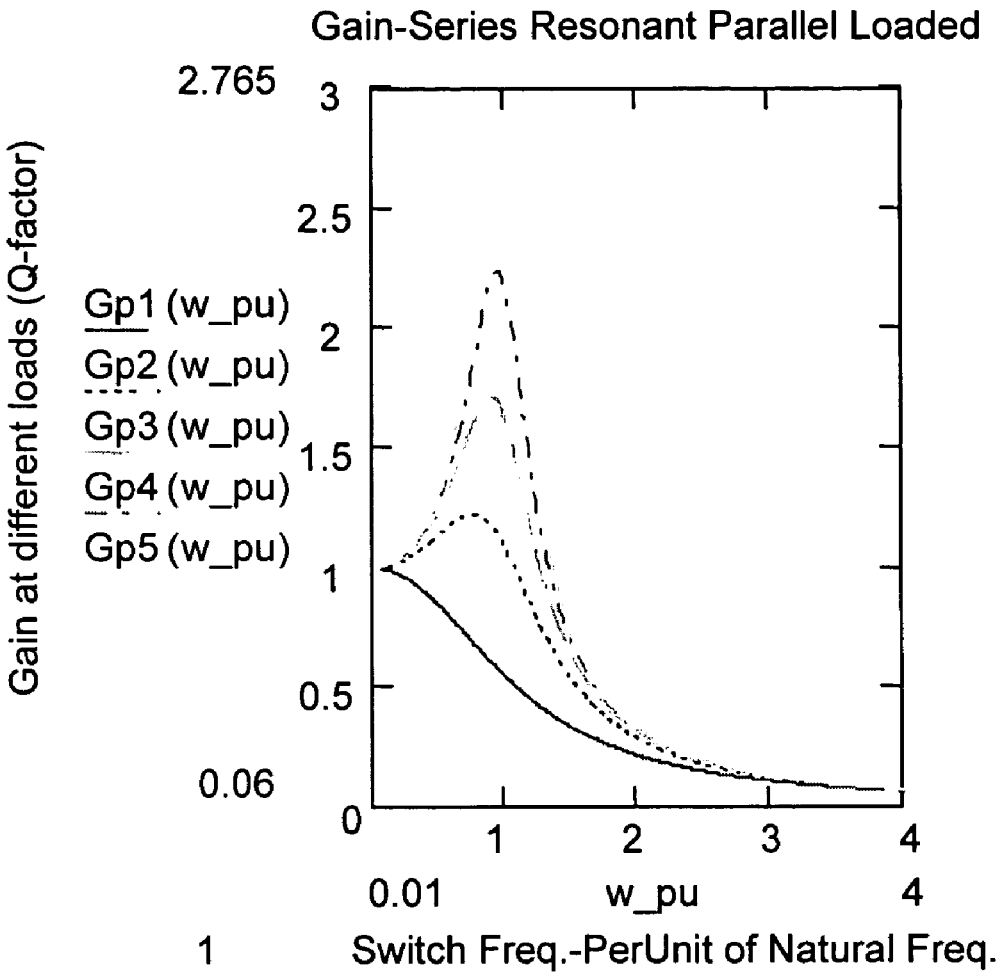
FIG. 1B shows the resonance characteristics of the series resonance parallel loaded circuit shown in FIG. 1A.
Figure 2:
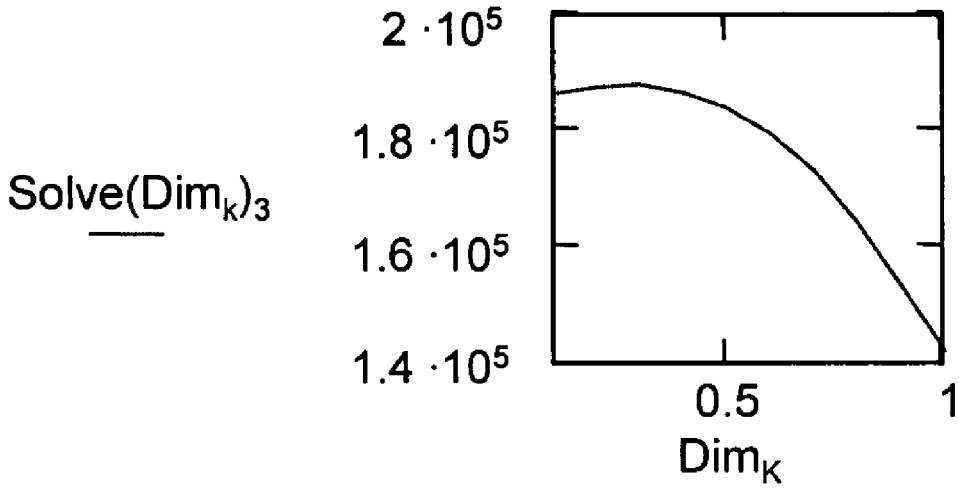
FIG. 2 illustrates the relation between dimming current and frequency of input pulses to a resonance circuit of an electronic ballast using the conventional frequency control.
Figure 3:
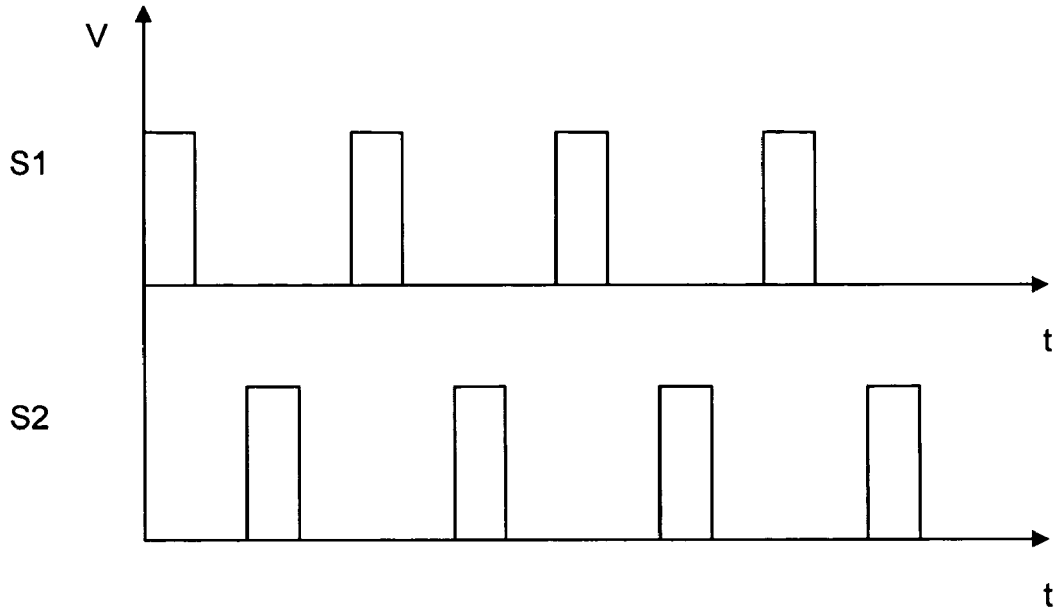
FIG. 3 PRIOR ART
FIG. 3 shows input pulses to a resonance circuit according to the conventional duty cycle control.
Figure 5A:
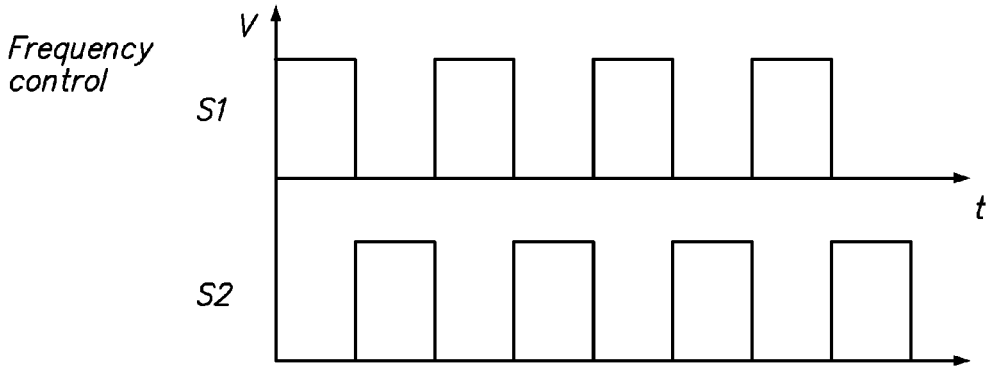
FIG. 5A shows input pulses to the resonance circuit shown in FIG. 4 at high load according to one embodiment of the present invention.

In one embodiment, when the load is adjusted from 100% to near threshold of losing the sensitivity to frequency control, the method of the present invention uses the conventional frequency control, and makes use of its symmetrical waveforms, i.e., D=0.5. FIG. 5A shows input pulses to the switching elements S1 and S2 shown in FIG. 4 at high load according to one embodiment of the present invention. The frequency f, can be increased to reduce the current $I_{lamp}$. As shown in FIG. 2, the $I_{lamp}$-$f_{sw}$ curve has a good slope in this range.

Figure 5B:
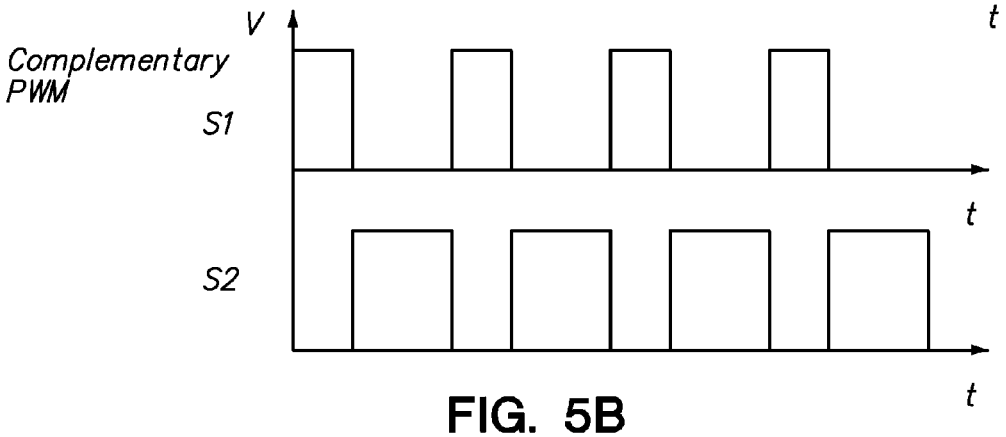
FIG. 5B shows input pulses to the resonance circuit shown in FIG. 4 at low load according to one embodiment of the present invention.
Figure 5C:
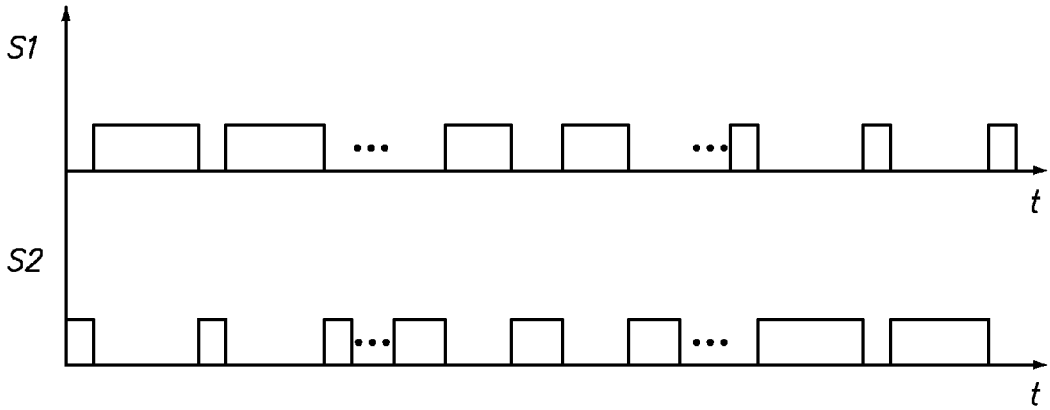
FIG. 5C shows input pulses to the resonance circuit shown in FIG. 4 at varying loads according to one embodiment of the present invention.

For dimming in low light, e.g., when the load is less than the threshold, the conventional frequency control does not respond accurately and becomes too sensitive and hard to adjust. The present invention uses pulse width control with complementary gating of switches, or PWM. The frequency $f_{sw}$ is fixed at the last adjusted $f_{sw}$ value, the turn on time of the switching element M1 is reduced, and the turn on time of the switching element M2 is complementarily increased to adjust the current $I_{lamp}$. As shown in FIG. 5B, during a working cycle $T_{sw}$ of the two switching elements, when one of the switching elements turns off, the other turns on. There is no gap between turn on (or close) times of the two switching elements, except for a short adaptive delay (based on the turn-on, turn-off time of switches) to prevent short-circuiting the output from the PFC boost. There is no overlap between the turn on time of the two switching elements either. The complementary gating of M1 and M2 could be implemented as a part of a semiconductor chip, with enough delay to avoid overlap. Also, as shown in FIG. 5C, the complementary gating and consequent complementary adjustment of duty cycles can vary over any given sequence of operation.

In the complementary pulse width control mode, the duty cycle D is smaller than 0.5. A resonance wave is assumed with different amplitude and phase for two states:

State I: $V_{in}=V_{dc}$, when $0 \leqq t \leqq DT_{sw}$; and

State II: $V_{in}=0$, when $DT_{sw} \leqq t \leqq T_{sw}$.

Thus, the mixed mode control of the present invention could achieve a smooth continuous $I_{lamp}$, or output light, control range from 100% to 10% or lower.

From the above relations (1)-(3), though a third order differential equation could be defined, since C2>>C1, the role of C2 in the main resonance response could be ignored and is merely intended to block the average DC component of the input pulses. A second order equation of resonance between L and C1 is introduced by the general form:

$$S^2+\xi S+\omega_o^2=0, \text{ wherein}$$

$$\xi=R_{lamp}/L; \text{ and}$$

$$\omega_o^2=1/LC1$$

The general solution for the inductor current with complex roots ($\tau \pm j\omega_r$) of the above equation would give:

$$i_L = e^{\tau t}(A_1 \mathrm{Sin}\omega_r t + A_2 \mathrm{Cos}\omega_r t) \quad (4)$$

$$\tau = -R_{lamp}/2L; \text{ and}$$

$$\omega_r = \sqrt{\left(\frac{1}{LC1}\right) - \left(\frac{1}{4R_{lamp}^2 C1^2}\right)}$$

The effect of load resistance on resonance frequency is usually expressed by the quality factor:

$$Q_L = R_{lamp}/\sqrt{L/C1} = R_{lamp}/L\omega_o = R_{lamp}C\omega_o;\ \omega_r^2 = \omega_o^2(1 - 1/4Q_L^2)$$

At steady state, i.e., $e^{\tau t}$ decayed, the general form of resonance current through the inductor is a resonating sine wave with the DC component of forced response. The DC forced response of $i_L$ would be $V_{in} - V_{av}/R_{lamp}$:

$$i_L(t) = [I_m \sin(\omega_r t - \Phi)] + (V_{in} - V_{av})/R_{lamp} \quad (5)$$

wherein the constants $I_m$ and $\Phi$ could be derived from the Initial Conditions of $i_L$ and $V_{C1}$ at the switching instants or as derived below by the boundary solution, $I_m$ represents the peak of the sinusoidal current flowing through the inductor L. The general form of the lamp current is:

$$i_{lamp}(t) = [v_{c1}(t) - V_{av}]/R_{lamp} \quad (6)$$

The voltage across C1 is:

$$v_{c1}(t) = V_{in} - L[di_L(t)/dt] = V_{in} - L\omega_r I_m.\cos\omega_r t - \Phi \quad (7)$$

The voltage across C2 is the average of the input pulses that is blocked from the lamp plus a small AC oscillation of charging/discharging around this DC component which represents the current through the load, $i_{c2} = i_{lamp} = C_2(dv_{c2}/dt)$. As $C_2$ is much bigger than $C_1$ this AC component of voltage across $C_2$ is very small and can be ignored.

$$v_{c2} = V_{av} = DV_{dc} \quad (8)$$

Figure 6A:
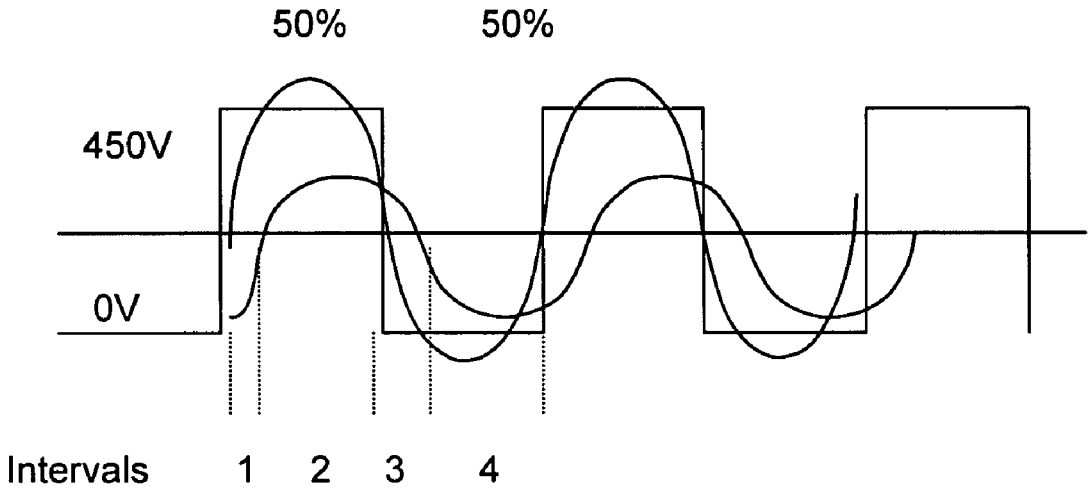
FIG. 6A shows two distinct states of input voltage and four intervals of conduction according to one embodiment of the present invention.

FIG. 6A shows two distinct states of input voltage and four intervals of conduction with their equivalent circuits. State I includes intervals 1 and 2, during which the $V_{in}$ is $V_{dc}$. State II includes intervals 3 and 4, during which the $V_{in}$ is 0V.

As the above resonance circuit operates with zero voltage switching (ZVS), in FIG. 4, diode D1 is conducting when switch S1 turns ON).

Figure 6B:
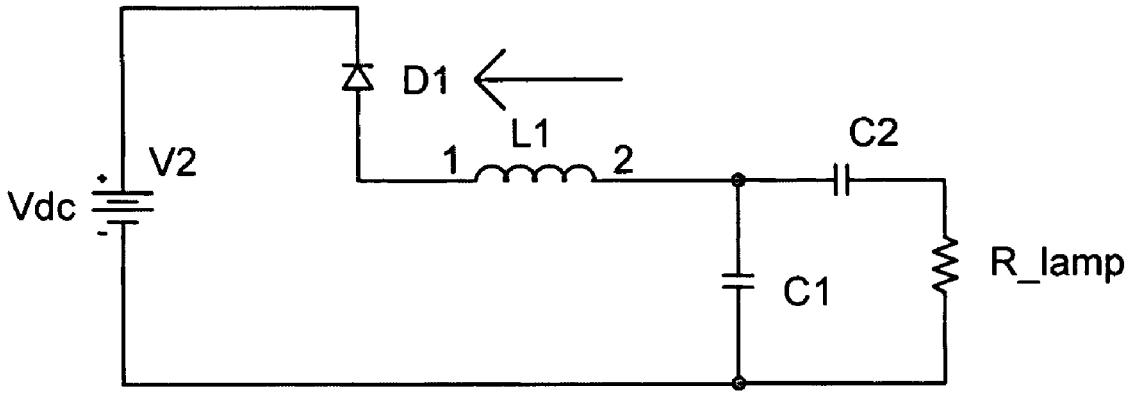
FIGS. 6B-6E show equivalent circuits for the four intervals of conduction.

During interval 1, as shown in FIG. 6B, D1 is conducting, and Vin=$V_{dc}$. The current direction in the resonant tank circuit is negative, feeding back the output of the PFC Boost.

Figure 6C:
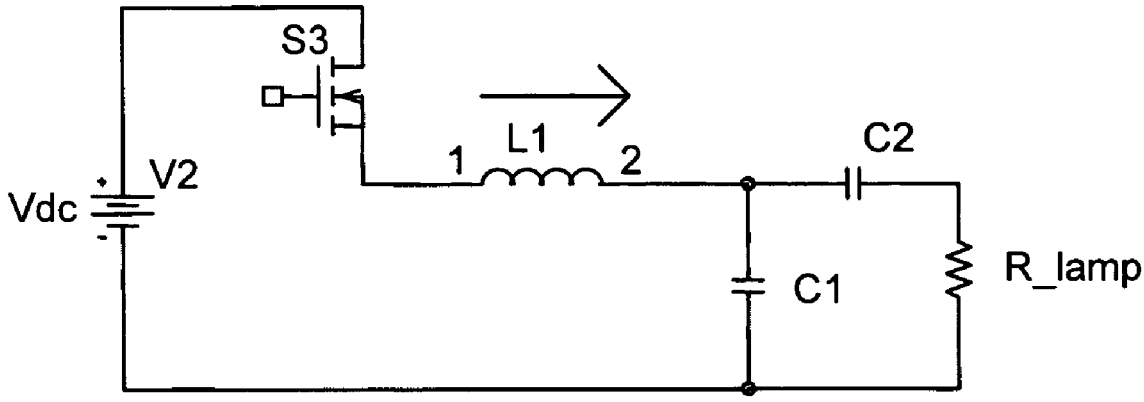

During interval 2, as shown in FIG. 6C, S1 is conducting, and $V_{in} = V_{dc}$. The current direction in the resonant tank circuit is positive.

Figure 6D:
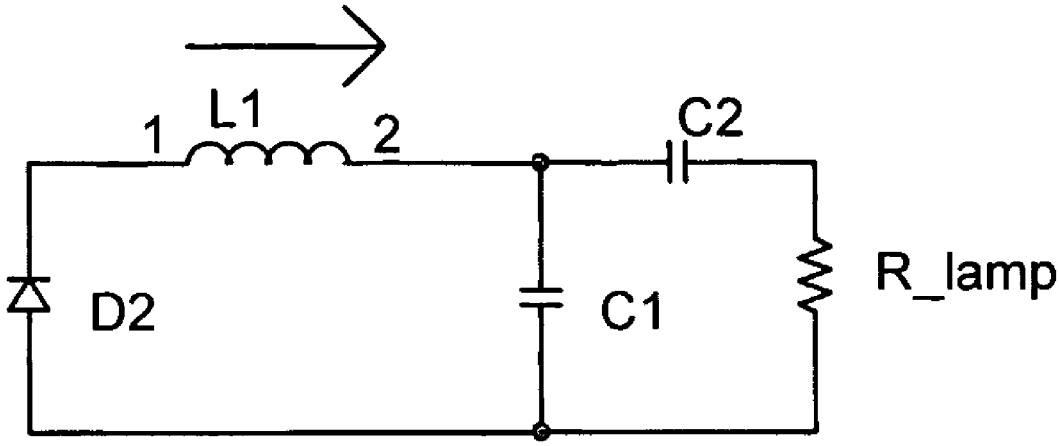

During interval 3, as shown in FIG. 6D, D2 is conducting, and $V_{in}$=0V. The current direction in the resonant tank circuit is changed from positive to negative.

Figure 6E:
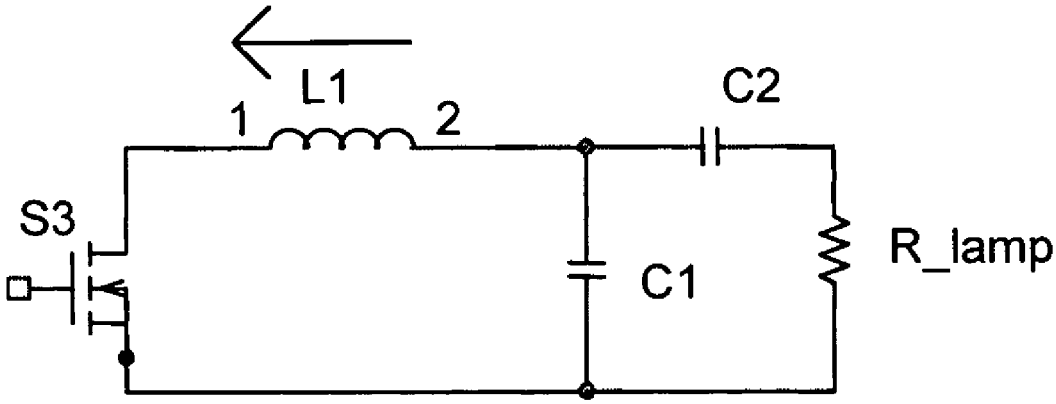

During interval 4, as shown in FIG. 6E, S2 is conducting, and $V_{in}$=0V. The current direction in the resonant tank circuit is negative.

The above differential equations derived for the resonant tank are solved for each of the two states. As a result, the resonating inductor current for each state is as follows:

State I: when $0 \leqq t \leqq DT_{sw}$, $V_{in} = V_{dc}$, $i_L(t) = I_{m1} \sin(\omega_r t - \Phi 1) + ((1-D)V_{dc}/R_{lamp}$; and State II: when $DT_{sw} \leqq t \leqq T_{sw}$, $V_{in}$=0, $i_L(t) = I_{m2}.\sin[\omega_r(t - DT_{sw}) - \Phi 2] - DV_{dc}/R_{lamp}$ Equalizing the inductor currents and capacitor voltages at the boundary of these states gives the boundary values of inductor current, capacitor voltage, and the relation between the current of lamp $I_{lamp}$ at dimming condition and the pulse width, or duty cycle D, could be derived.

Figure 7:
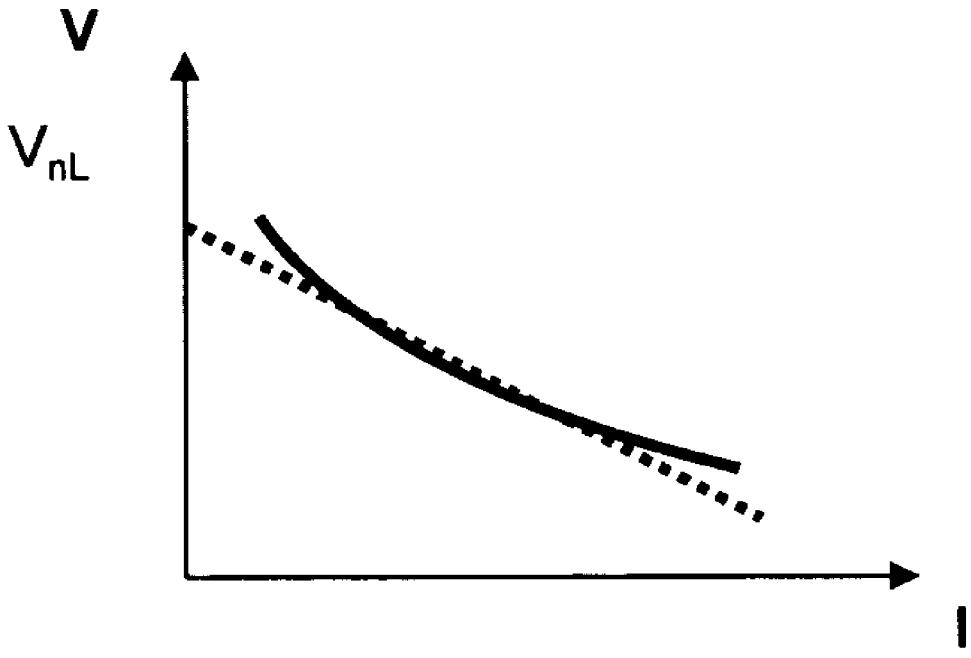
FIG. 7 shows an approximate graph of a fluorescent VI characteristic.
Figure 8A:
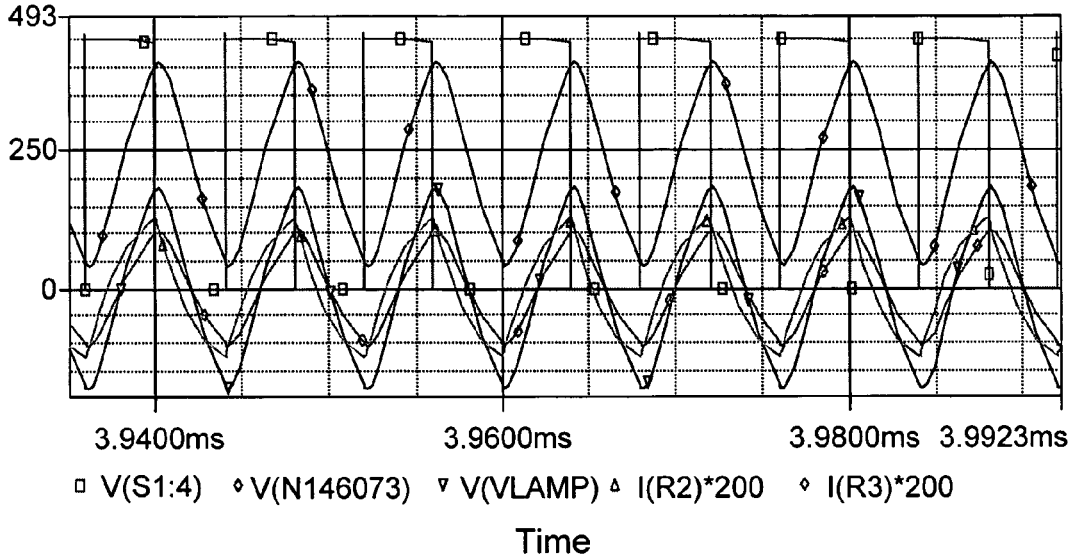
FIGS. 8A-8D illustrate simulation waveforms of the operation in different dimming current by mixed mode control of frequency and duty cycle, according to one embodiment of the present invention.
Figure 8B:
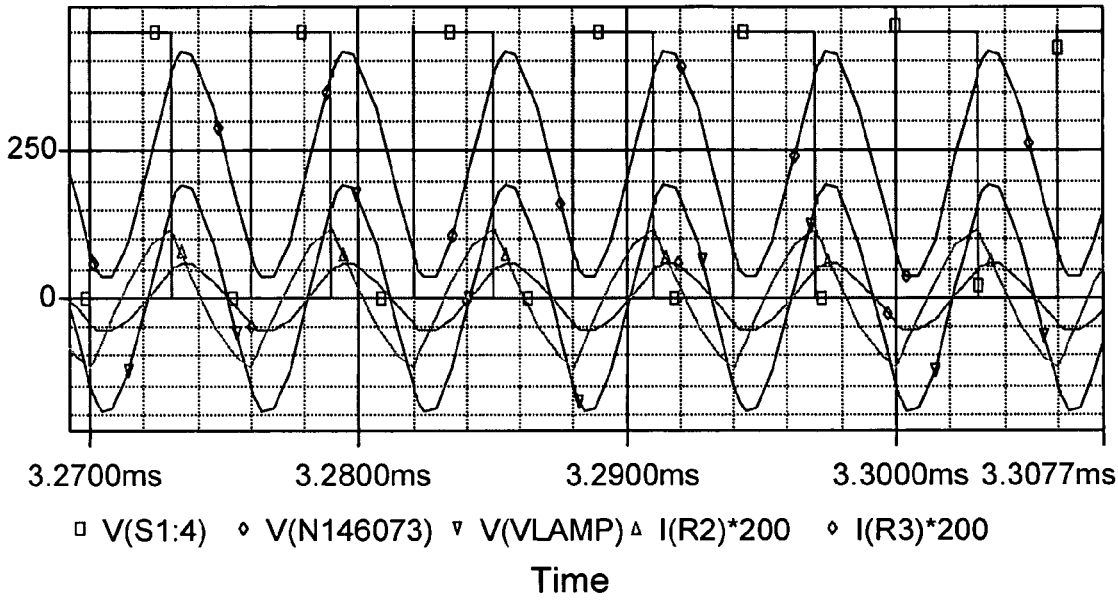
Figure 8C:
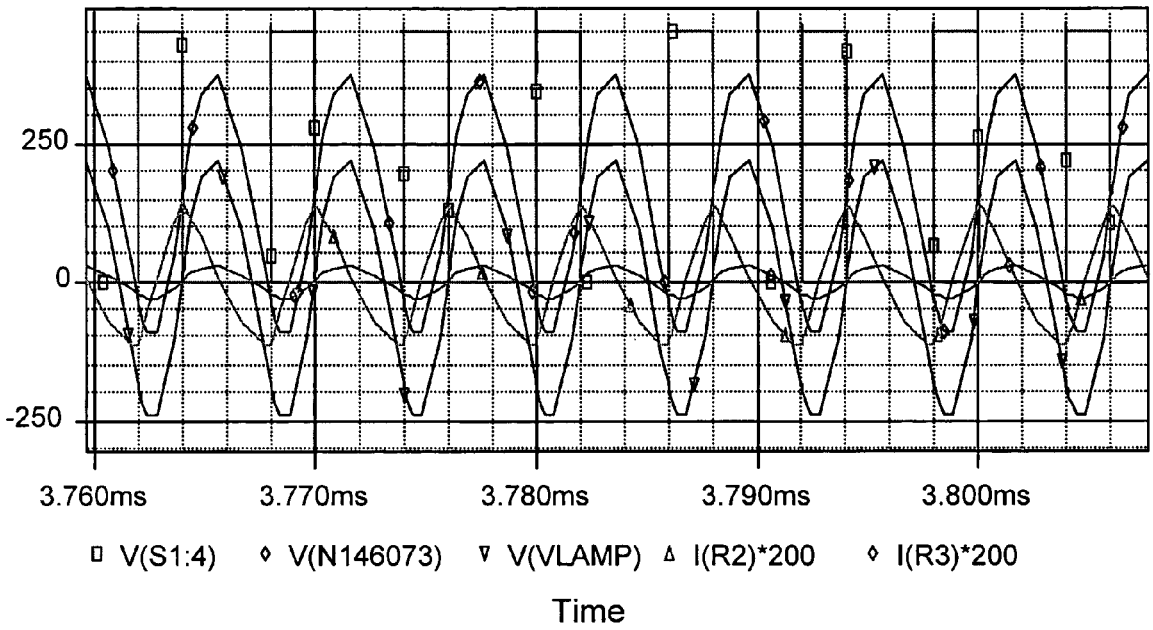
Figure 8D:
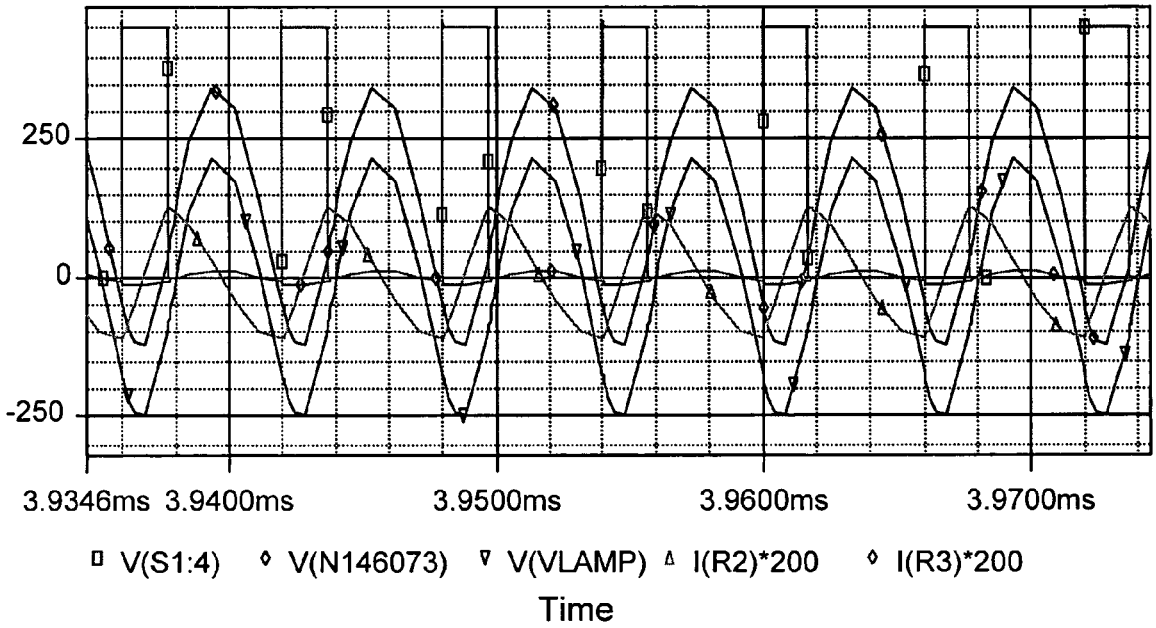

Specifically, lamp resistance at each dimming condition is defined based on the linearized approximation of the VI characteristics of the fluorescent lamp. An approximate graph of a fluorescent VI characteristic is shown in FIG. 7.

In the general approximation of the VI characteristic, the relation for the rms values could be written as follows:

$V_{lamp_rms} = V_{n1} - R_{neg}.I_{lamp_rms}$ wherein $V_{n1}$ represents the cross point of the approximate line with V-axis and $R_{neg}$ represents the negative slope of the line.

Consequently, the equivalent resistance of lamp at each operating point is defined by:

$$R_{lamp} = V_{lamp_rms}/I_{lamp_rms} = (V_{lamp_rms}/I_{lamp_rms}) - R_{neg} \quad (9)$$

When $0 \leqq t \leqq DT_{sw}$, $V_{in} V_{dc}$, and $$i_L(t) = I_{m1} \sin(\omega_r t - \Phi 1) + ((1-D)V_{dc})/R_{lamp}; \quad (10)$$

$$v_{c1}(t) = V_{dc} - L\omega_r I_{m1} \cos(\omega_r t - \Phi 1);\ v_{c2} \approx DV_{dc} \quad (11)$$

$$i_{lamp}(t) = (1/R_{lamp})[(1-D)V_{dc} - L\omega_r I_m \cos(\omega_r t - \Phi 1)]; \quad (12)$$

When $DT_{sw} \leqq t \leqq T_{sw}$, $V_{in}$=0; time shift of $DT_{sw}$ $$i_L(t) = I_{m2}.\sin[\omega_r(t - DT_{sw}) - \Phi 2] - DV_{dc}/R_{lamp}; \quad (13)$$

$$v_{c1}(t) = -L\omega_r I_{m2}.\cos[\omega_r(t - DT_{sw}) - \Phi 2];\ v_{cs} \approx DV_{dc} \quad (14)$$

$$i_{lamp}(t) = (1/R_{lamp})\{-DV_{dc} - L\omega_r I_{m1}.\cos[\omega_r(t - DT_{sw}) - \Phi 2]\}; \quad (15)$$

From the boundary conditions for the inductor current and capacitor voltage, the following equations could be derived (in literature usually the frequency ratio $y = \omega_{sw}/\omega_r = F_{sw}/F_r$ is used in relations):

when t=0, or $T_{sw}$:

$$-I_{m1} \sin \Phi 1 + ((1-D)V_{dc})/R_{lamp} = I_{m2} \sin[\omega_r(1-D)T_{sw} - \Phi 2] - (DV_{dc})/R_{lamp}; \quad (16)$$

$$V_{dc} - L\omega_r I_{m1} \cos \Phi 1 = -L\omega_r I_{m2} \cos[\omega_r(1-D)T_{sw} - \Phi 2]; \quad (17)$$

when $t = DT_{sw}$:

$$I_{m1} \sin(\omega_o DT_{sw} - \Phi 1 + ((1-D)V_{dc})/R_{lamp}; = -I_{m2} \sin(\Phi 2) - (DV_{dc})/R_{lamp} \quad (18)$$

$$V_{dc} - L\omega_r I_{m1} \cos(\omega_r DT_{sw} - \Phi 1) = -L\omega_r I_{m2} \cos(\Phi 2) \quad (19)$$

An extra relation between the adjusted dimming current and the required control of the duty cycle is obtained from calculation of the lamp RMS current from the $i_{lamp}$ waveform as below:

$$I_{\mathrm{lamp_rms}} = \sqrt{\frac{1}{T}\left[\int_0^{DT} i_{lamp}^2\, dt + \int_{DT}^{T} i_{lamp}^2\, dt\right]} \quad (20)$$

$$I_{\mathrm{lamp_rms}}^2 = \frac{1}{T}\left\{\int_0^{DT} \frac{Vdc^2(1-D)^2}{R_{lamp}^2} + \frac{L^2\omega_r^2 I_{m1}^2}{2R_{lamp}^2}[1 + \cos(2\omega_r t - 2\phi_1)] - \frac{2Vdc(1-D)L\omega_r I_{m1}}{R_{lamp}^2}\cos(\omega_r t - \phi_1) + \ldots + \int_{DT}^{\tau} \frac{Vdc^2 D^2}{R_{lamp}^2} + \frac{L^2\omega_r^2 I_{m2}^2}{2R_{lamp}}[1 + \cos(2\omega_r t - 2\phi_2)] + \right.$$

-continued $$\frac{2VdcDL\omega_r I_{m2}}{R_{lamp}}\cos(\omega_r t-\phi_2)\Big\}$$

Using the boundary values calculated by equations (16)-(20), the relation between the total RMS current of $I_{lamp}$ and D is derived. By sensing of circuit parameters, based on the derived relations, the controller would adjust the Frequency/Duty Cycle for the required dimming.

Alternatively, the relation of the real power and energy transferred from ballast input to output lamp could be used. Ignoring the parasitic losses in the circuit, the average of input power (that is only during state I, $0 \leqq t \leqq DT_{sw}$ and $V_{in}=V_{dc}$) to the output power consumed in the fluorescent lamp is:

$$Pin = Pout = V_{\text{lamp_rms}} \cdot I_{\text{lamp_rms}}; \tag{21'}$$

$$P_{\text{in}} = \frac{1}{T_{sw}}\int_0^{DTsw} V_{\text{dc}}\left[I_{ml}\sin(\omega_r t-\phi_1)+\frac{(1-D)Vdc}{R_{lamp}}\right]dt = -\frac{V_{\text{dc}}I_{ml}}{T_{sw}\omega_r}[\cos(\omega_r t-\phi_1)]_0^{DTsw}+\left[\frac{(1-D)Vdc^2}{R_{lamp}}t\right]_0^{DTsw} = \frac{V_{\text{dc}}I_{ml}F_{sw}}{\omega_r}\left[cos\phi_1-\cos\left(\frac{\omega_r D}{F_{sw}}-\phi_1\right)\right]+\frac{D(1-D)Vdc^2}{R_{lamp}},$$

$$V_{\text{lamp_rms}}I_{\text{lamp_rms}} = \frac{V_{\text{dc}}I_{ml}F_{sw}}{\omega_r}\left[\cos\phi_1-\cos\left(\frac{\omega_r D}{F_{sw}}-\phi_1\right)\right]+\frac{D(1-D)Vdc^2}{R_{lamp}} \tag{21}$$

According to another aspect of the present invention, the elements of the ballast of the present invention, L, C1 and C2, could be optimized for high efficiency and high performance at full load.

FIGS. 8A-8D illustrate operational simulated waveforms of the mixed mode control, with different values of dimming current, frequency and duty cycle, according to one numerical example for an embodiment of the present invention.

Figure 9A:
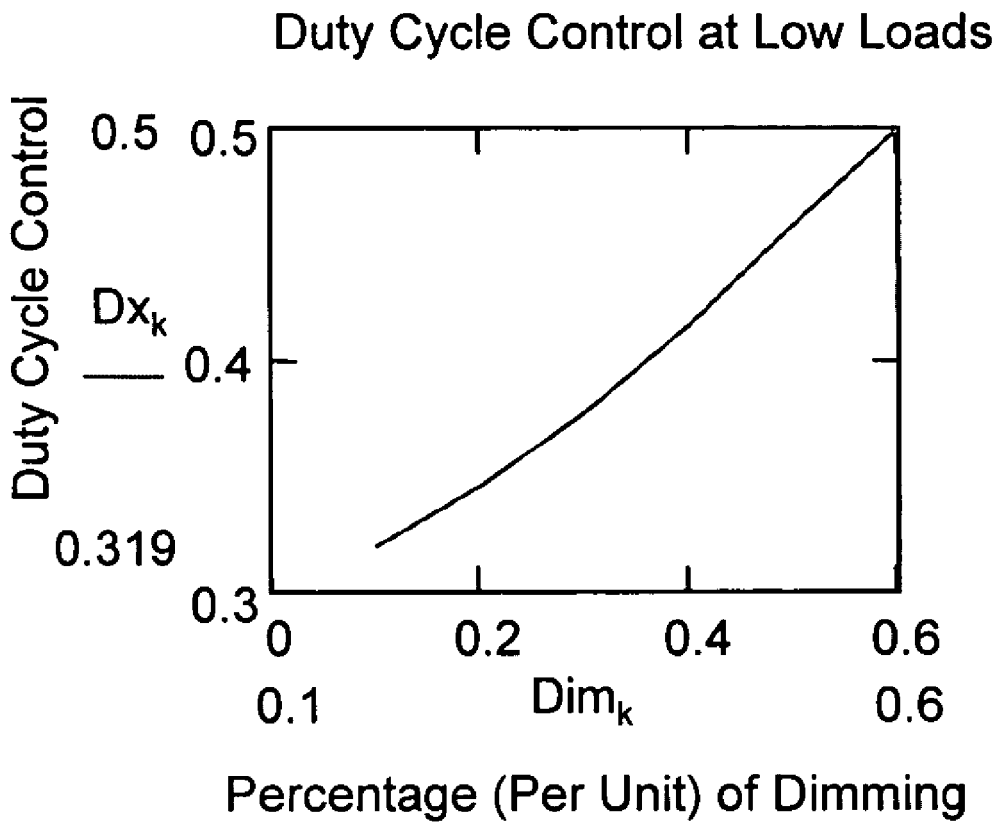
FIGS. 9A and 9B show the two portions of dimming control characteristic illustrating the relation between dimming current and frequency (at higher loads)/duty cycle (at lower loads) during mixed mode dimming control according to one embodiment of the present invention.
Figure 9B:
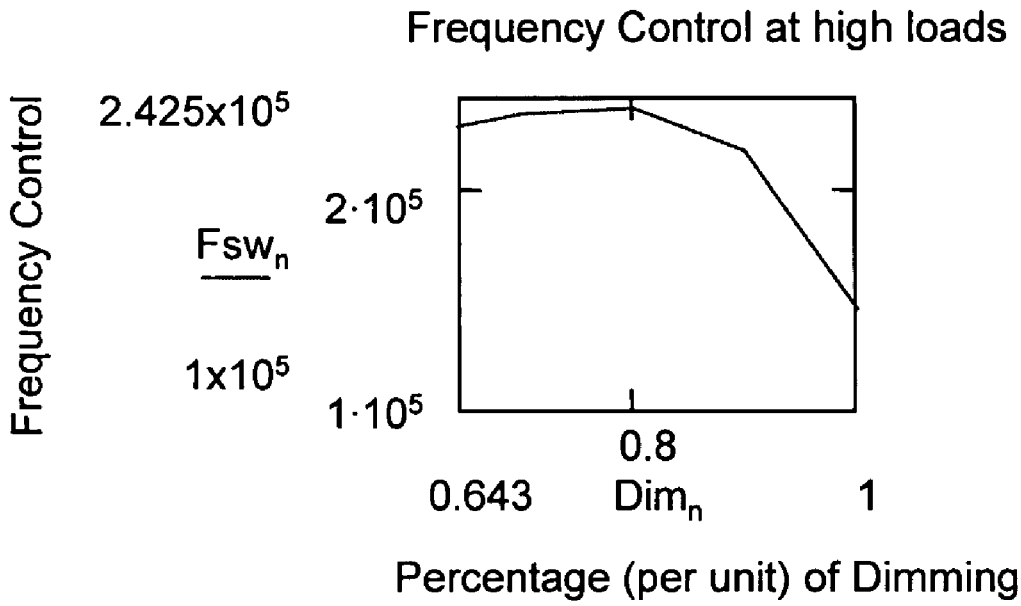

FIGS. 9A and 9B show the two portions of dimming control characteristic illustrating the relation between dimming current and frequency (at higher loads)/duty cycle (at lower loads) during mixed mode dimming control according to one embodiment of the present invention.

Figure 10:
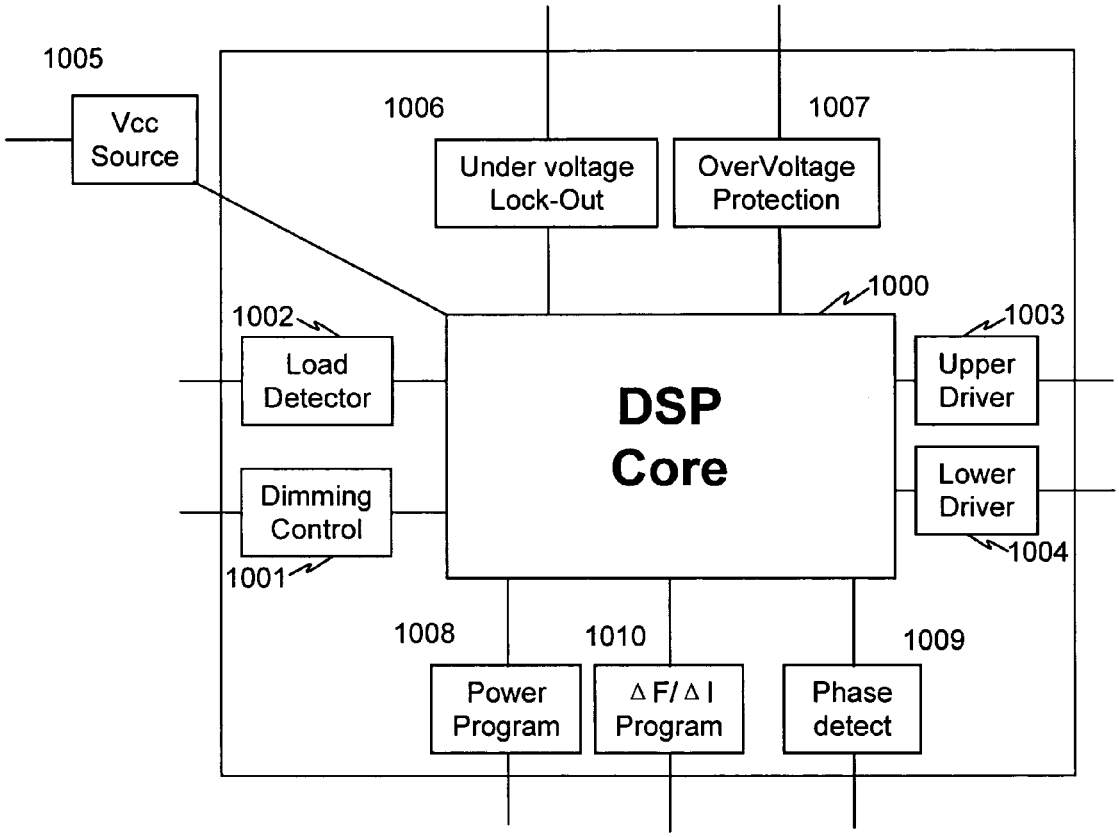
FIG. 10 shows a basic block diagram of the mixed mode controller 100 shown in FIG. 4 according to one embodiment of the present invention.

FIG. 10 shows a basic block diagram of the mixed mode controller 100 shown in FIG. 4 according to one embodiment of the present invention. As shown, a dimming control 1001 provides a processor, e.g., a DSP core 1000, with dimming signals, and a load detector 1002 informs the DSP core 1000 whether the load of the circuit is below a threshold. When the load is not below the threshold, the DSP core 1000 outputs signals to an upper driver 1003, which drives the switches, e.g., S1 and S2 shown in FIG. 4, to operate in a frequency control mode. When the load is below the threshold, the DSP core 1000 outputs signals to a lower driver 1004, which drives the switches to operate in a complementary duty cycle control mode. The mixed mode controller 100 receives voltage signal from a Vcc source 1005. The mixed mode controller 100 also has: an under voltage lock out module 1006 and an over voltage protection module 1007 for protecting the DSP core 1000 from under voltage and over voltage; a power program block 1008 for control the power of the DSP core 1000; a phase detect block 1009 for detecting a phase of the input signal; and a ΔF/ΔI program block 1010 for calculating ΔF/ΔI.

While the invention has been described in detail above with reference to some embodiments, variations within the scope and spirit of the invention will be apparent to those of ordinary skill in the art. For example, the lamp is not limited to a fluorescent lamp, but could be another type of discharge lamp. In addition, the load threshold could go higher or lower based on the optimization point of the design and input/output voltages required. Thus, the invention should be considered as limited only by the scope of the appended claims, and not by the described embodiments.

What is claimed is:

1. A method for controlling a dimmable discharge lamp, the method comprising:

determining whether a load of the dimmable discharge lamp is lower than a load threshold; and when the load is lower than the load threshold, controlling an output of the dimmable discharge lamp by complementarily adjusting a duty cycle of a first control signal and a duty cycle of a second control signal.

2. The method according to claim 1, further comprising:

controlling the output of the dimmable discharge lamp by adjusting a frequency of third and fourth control signals when the load is not lower than the load threshold.

3. The method according to claim 1, wherein when one of the first and second control signals turns off, the other control signal turns on substantially immediately.

4. The method according to claim 3, wherein the time between the turn on time of one of the control signals and the turn off time of the other control signal differs only by a delay sufficient to prevent a short circuit.

5. The method according to claim 1, wherein there is no overlap between the turn on time of one of the control signals and the turn off time of the other control signal.

6. The method according to claim 1, wherein the duty cycle of the first and second control signals is lower than 50% when the load is lower than the load threshold.

7. An apparatus for controlling a dimmable discharge lamp, the apparatus comprising:

a load detector, determining whether a load of the dimmable discharge lamp is lower than a threshold; and a controller, which receives inputs from the load detector and a dimming controller, wherein when the load is lower than the threshold, the controller outputs a first control signal and a second control signal to control an output of the dimmable discharge lamp by complementarily adjusting a duty cycle of the first control signal and a duty cycle of the second control signal.

8. The apparatus according to claim 7, further comprising a first driver through which the controller outputs the first and second control signals.

9. The apparatus according to claim 7, wherein the controller outputs a third control signal and a fourth control signal to control the output of the dimmable discharge lamp by adjusting a frequency of the third control signal and a frequency of the fourth control signal when the load is not lower than the threshold.

10. The apparatus according to claim 9, further comprising a second driver through which the controller outputs the third and fourth control signals.

11. The apparatus according to claim 7, wherein when one of the first and second control signals turns off, the other control signal turns on substantially immediately.

12. The apparatus according to claim 11, wherein the time between the turn on time of one of the control signals and the turn off time of the other control signal differs only by a delay sufficient to prevent a short circuit.

13. The apparatus according to claim 11, wherein there is no overlap between the turn on time of one of the control signals and the turn off time of the other control signal.

14. The apparatus according to claim 7, further comprising an under voltage lock-out module.

15. The apparatus according to claim 7, further comprising an over voltage protection module.

16. The apparatus according to claim 7, further comprising a power control module.

17. The apparatus according to claim 7, further comprising a phase detector.

18. The apparatus according to claim 7, wherein the dimmable discharge lamp comprises a fluorescent lamp.

19. An apparatus for controlling a dimmable discharge lamp, the apparatus comprising:

means for detecting whether a load of the discharge lamp is lower than a threshold; and controlling means, which receives inputs from the detecting means and a dimming controlling means, wherein when the load is lower than the threshold, the controlling means outputs a first control signal and a second control signal to control an output of the dimmable discharge lamp by complementarily adjusting a duty cycle of the first control signal and a duty cycle of the second control signal.

20. The apparatus according to claim 19, further comprising first driving means through which the controlling means outputs the first and second control signals.

21. The apparatus according to claim 19, wherein the controlling means outputs a third control signal and a fourth control signal to control the output of the dimmable discharge lamp by adjusting a frequency of the third control signal and a frequency of the fourth control signal when the load is not lower than the threshold.

22. The apparatus according to claim 21, further comprising second driving means through which the controlling means outputs the third and fourth control signals.

23. The apparatus according to claim 19, wherein when one of the first and second control signals turns off, the other control signal turns on substantially immediately.

24. The apparatus according to claim 23, wherein the time between the turn on time of one of the control signals and the turn off time of the other control signal differs only by a delay sufficient to prevent a short circuit.

25. The apparatus according to claim 23, wherein there is no overlap between the turn on time of one of the control signals and the turn off time of the other control signal.

26. The apparatus according to claim 19, further comprising means for under voltage protection.

27. The apparatus according to claim 19, further comprising means for over voltage protection.

28. The apparatus according to claim 19, further comprising means for power control.

29. The apparatus according to claim 19, further comprising means for phase detecting.

30. The apparatus according to claim 19, wherein the dimmable discharge lamp comprises a fluorescent lamp.

* * * * *